US006910598B2

(12) United States Patent
Götz et al.

(10) Patent No.: US 6,910,598 B2
(45) Date of Patent: Jun. 28, 2005

(54) CONTAINER COMPRISING A TURN-LOCK FASTENER

(76) Inventors: Hermann Götz, Walter-Rathenau-Strasse 39, D-65428 Rüsselsheim (DE); Bruno Ackermann, Königsberger Strasse 103, D-55268 Nieder-Olm (DE); Dieter Folland, Pfarrgasse 32, D-65293 Hochheim 2 (DE)

( * ) Notice: Subject to any disclaimer, the term of this patent is extended or adjusted under 35 U.S.C. 154(b) by 148 days.

(21) Appl. No.: 10/221,281

(22) PCT Filed: Mar. 2, 2001

(86) PCT No.: PCT/EP01/02361

§ 371 (c)(1),
(2), (4) Date: Jan. 21, 2003

(87) PCT Pub. No.: WO01/66431

PCT Pub. Date: Sep. 13, 2001

(65) Prior Publication Data

US 2003/0155360 A1 Aug. 21, 2003

(30) Foreign Application Priority Data

Mar. 8, 2000 (DE) ..... 200 04 152 U

(51) Int. Cl.[7] ..... B65D 51/20
(52) U.S. Cl. ..... 220/258.3; 220/906
(58) Field of Search ..... 220/258.4, 258.5, 220/258.3, 258.1, 259.3, 267, 268, 277, 278, 253, 906

(56) References Cited

U.S. PATENT DOCUMENTS 3,708,091 A 1/1973 Douty
3,726,432 A 4/1973 Gentile
3,924,777 A * 12/1975 Peyser ..... 220/277
3,949,898 A * 4/1976 Patel et al. ..... 220/277
4,125,203 A 11/1978 Sovari et al.
4,795,043 A * 1/1989 Odet et al. ..... 215/235
4,821,912 A * 4/1989 Wells ..... 220/231
5,269,432 A * 12/1993 Beckertgis ..... 220/253
5,692,633 A 12/1997 Gordon
5,816,427 A 10/1998 Beckertgis
6,216,904 B1 * 4/2001 Cagan ..... 220/253

FOREIGN PATENT DOCUMENTS

EP A1 0 340 835 4/1989 ..... B65D/17/44

* cited by examiner

*Primary Examiner*—Lien Ngo

(57) ABSTRACT

The invention to a container, especially a beverage container. The lid wall (2) is provided with a specified rupture line (6) which, when torn open, frees an opening (9) provided for drinking and pouring. A lid turn-lock fastener (10) comprises a wall (13), which spans the lid wall (2), and comprises means for tearing open the opening (9) provided for drinking and pouring. The lid turn-lock fastener is supported on the can when it is turned in order to tear open the opening (9) provided for drinking and pouring. The opening (9) provided for drinking and pouring extends between the rotational axis (4) and the circular periphery of the lid wall (2) and, in a radial direction, measures at least half of the radius length. The wall (13) of the lid turn-lock fastener (10) comprises an opening (15) which is left free, which, to a large extent, has the shape and size of the opening (9) provided for pouring, and which, by turning the lid turn-lock fastener (10), can be placed into a position in which it is located directly above said opening (9). The means used for tearing open comprise a projection (16) placed on the lid turn-lock fastener and comprise an inclined surface (5*a*) provided on the lid wall (2).

21 Claims, 6 Drawing Sheets

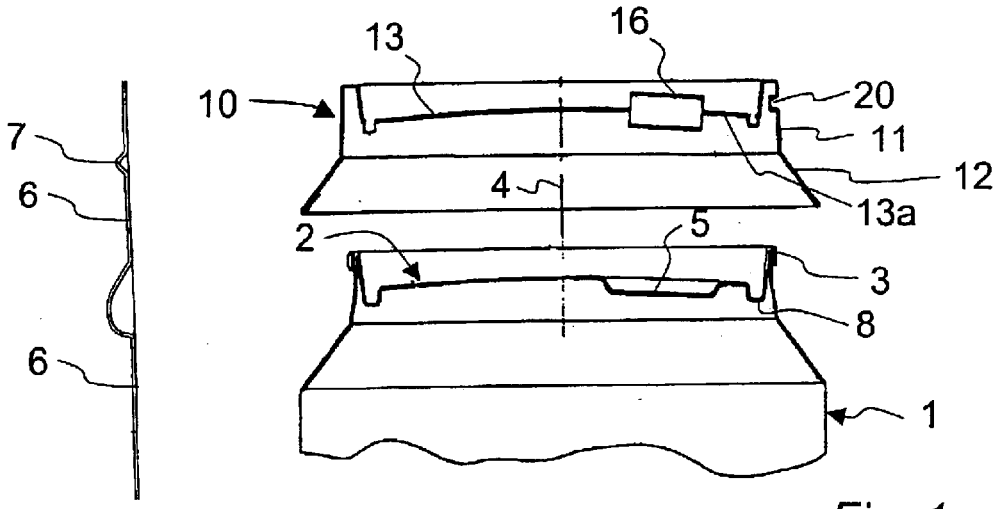
Fig. 1
Fig. 3
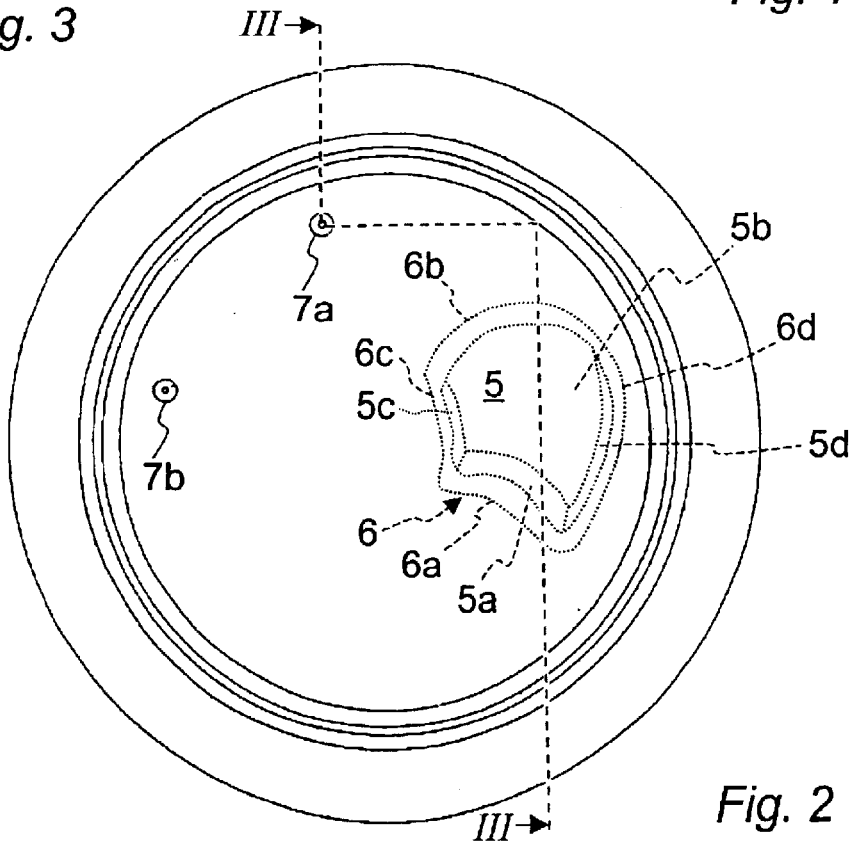
Fig. 2

CONTAINER COMPRISING A TURN-LOCK FASTENER

FIELD OF THE INVENTION

The invention relates to a container for accommodating free-flowing products, in particular in the form of a beverage can which is provided with a predetermined breaking line which, once broken open, produces a drinking or pouring opening.

BACKGROUND OF THE INVENTION

Beverage cans usually have a horseshoe-shaped predetermined breaking line which bounds a wall region on which a ring-pull tab is fastened. If such a beverage can has been opened by virtue of the tab being actuated, it is no longer possible to close it effectively, which, in the case of carbonated drinks, results in the can contents having to be consumed rapidly or the drink otherwise going flat.

In order to eliminate this shortcoming, it is already known (from DE 196 13 256 A1) to provide a lid-like closure element which has engagement elements which interact in the manner of the bayonet closure with mating engagement elements on a cylindrical wall of the can, the so-called core wall, in order thus for a drinking or pouring opening made in the can to be closed in an airtight manner. In order to produce this pouring opening, the closure element has arcuate pressure-exerting elements which engage in a canal of the lid wall of the can and, when the closure element is rotated, slide onto an obliquely upwardly sloping pressure-exerting surface of the canal in order thus to break open the predetermined breaking line which extends around the edge of the lid wall of the can. The disadvantage with this configuration of the beverage can-is the fact that the shape of the outline differs from that of the conventional beverage cans, with the result that it is not possible to stack these beverage cans with conventional beverage cans. During use, moreover, the closure element has to be removed from the beverage can in order to free the pouring opening.

A container as known from U.S. Pat. No. 3,726,432 is provided with a flat lid wall having a depression with a sloping surface wherein a tongue extends downwardly from an additional rotary lid closure. The container lid wall comprises a predetermined breaking line which encloses a circular section and a narrow arcuate section, the predetermined breaking line being interrupted in the circular section at a position which is opposite to the narrow arcuate section. When the additional rotary lid having the tongue on it is rotated, the tongue initially enters into the narrow arcuate section and then into the circular section and breaks the breaking line so as to pivote the wall flap so formed into the interior of the container. The wall flap is thereby bent at a position which is arranged between the ends of the predetermined breaking line. There is the danger that the lid wall makes a bulging or swell at this position so that no flat engagement exists with the wall of the rotatable lid and no good sealing can be expected.

A tin having a pair-of cap-shaped portions, each of which being surrounded by a predetermined breaking line can be opened with the help of an additional cover to be placed on the tin and having rising edges for opening the cap-shaped portions (see ~EP-A-0,340,835). The additional cover also comprises a pair of cylindrical parts which may be plugged into the openings of the container lid when the same have been opened by breaking the circular breaking lines in the container lid. It is doubtful whether or not such an opening can be sealingly closed in such a manner.

A beverage container is known from U.S. Pat. No. 5,816,427 which has drinking and pouring openings formed by slots parallel to one another, and a rotatable cover for forming the slots into the container lid and for covering same. Sealing of the beverage container which has been opened is not possible by this cover.

A further beverage container is known from U.S. Pat. No. 5,692,633 which has a rotary lid closure and a fixed container lid including a circular raised region surrounded by a predetermined breaking line. The rotary lid closure comprises an opening corresponding to the outline of the breaking line and a raised portion or emboss having a sloping surface which narrowly encompasses the raised region of the container lid. When rotating the rotary lid closure, the raised region of the container lid is sheared off along the predetermined breaking line.

SUMMARY OF THE INVENTION

A object of the present invention is to provide a container with rotary closure which can be configured such that it can be stacked with conventional containers of the same type.

A further object of the invention is to provide a container with rotary closure which is also suitable for sealing carbonated beverage.

A further object of the invention is to provide a container with rotary closure in the case of which the drinking or pouring opening can be opened and closed simple by virtue of the rotary closure being rotated (without being removed).

A further object of the invention is to provide a container with rotary closure in the case of which, on account of its relative size, a single pouring opening is sufficient to serve as a drinking opening.

The invention provides a rotary lid closure which is fitted rotatably on the container. The rotary lid closure has a protrusion by means of which a pouring opening in the lid wall of the container can be opened by virtue of the rotary lid closure being rotated. The rotary lid closure also has a cut-out opening which can be made to coincide with the pouring opening in the lid wall of the container in order for contents to be removed from the container. The cut-out opening in the rotary lid closure may also be rotated to a neutral location, whereupon wall parts of the rotary lid closure cover and close the pouring opening in the lid wall. The container and the rotary lid closure are provided with supporting means, with the result that the extent of support of the wall of the rotary lid closure on the edge of the pouring opening in the lid wall is sufficient to seal even carbonated beverage.

In detail, the rotary lid closure is positioned on the can as a cap and retained thereon by means of clips which, in the case of commercially available metal cans, engage behind the edge seam. Three clips are sufficient, and these grip firmly, by way of their depressions, on the edge seam and retain the rotary closure without preventing the latter from rotating. The cap form of the rotary closure provides sufficiently large grip surface areas for the hand, with the result that the rotary closure can be conveniently grasped and rotated, a long lever length being formed. In order to open the pouring opening, i.e. that region of the lid wall which is bounded by notched weakening lines, a protrusion is provided on the rotary closure, and this protrusion can be pressed into the bounded region by virtue of the rotary closure being actuated, with the result that the lid breaks along a short section of the weakening lines. Further rotation of the rotary closure allows the protrusion to be displaced over the surface of the bounded region, with the result that the lid wall is increasingly bent downward in this bounded region and the crack propagates along the notched weakening lines until the pouring opening has been completed. In the preferred embodiment of the invention, the cut-out opening in the rotary lid closure here overlaps with the pouring opening in the lid wall of the container. The container is closed by virtue of the rotary lid closure being rotated back.

It is particularly advantageous that it is possible to use commercially available cans, the only difference being that, instead of fitting the ring pull tab, the latter is replaced by the rotary closure. It is further advantageous that the rotary closure seals well in its closed position, with the result that it is even possible for carbonated beverage to be kept under a certain pressure in the can.

BRIEF DESCRIPTION OF THE DRAWING

The invention will be described with reference to the drawing, in which:

FIG. 1 shows, in an exploded view, a section through the top part of a can with rotary closure, FIG. 2 shows the view of the lid wall of the can, on a larger scale than FIG. 1, FIG. 3 shows a section along line III—III from FIG. 2.

DESCRIPTION OF THE EMBODIMENTS

Figure 4:
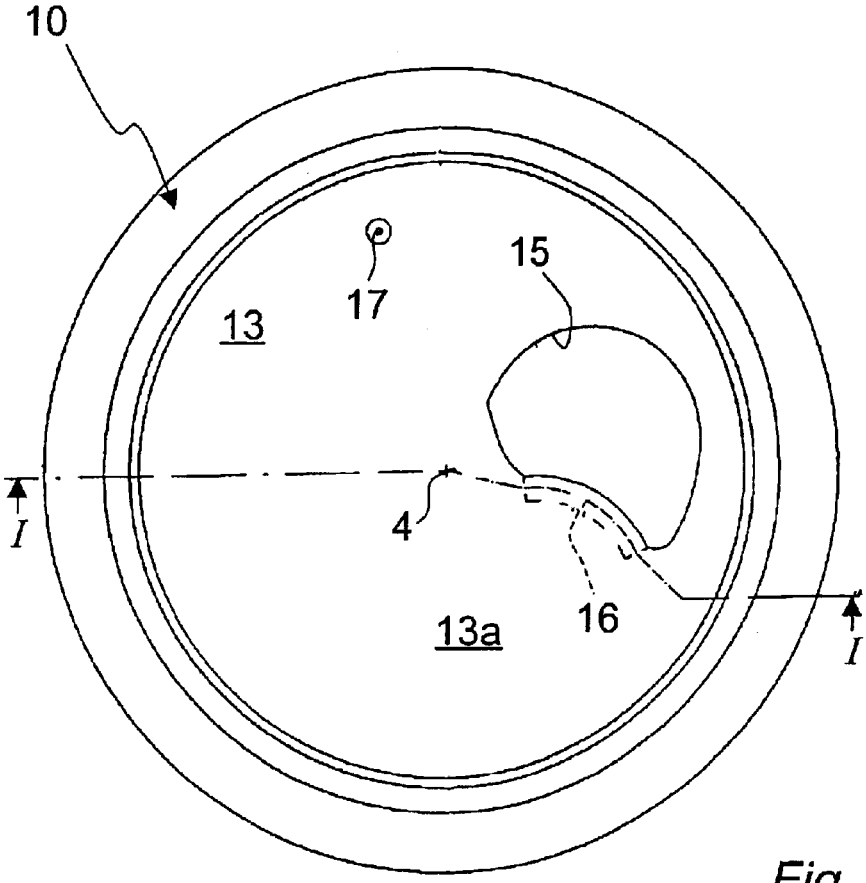
FIG. 4 shows the view of a rotary closure.

FIG. 1 shows the top end of a can, i.e. a rotationally symmetrical wall region 1, e.g. made of tin plate, which is closed by a lid wall 2, e.g. made of aluminum, an edge seam 3 being formed. The lid wall 2 has an encircling groove 8 and a bounded region 5, which is sunken to some extent in relation to the plane of the lid wall 2 and has been prepared via notched weakening lines 6, as predetermined breaking lines (FIG. 2), for a partial breaking-open action. Two latching locations in the form of indents 7*a*, 7*b* are also provided on the lid wall 2.

As can be seen from FIG. 2, the weakening grooves 6 have arcuate sections 6*a*, 6*b*, 6*c* and 6*d*. The arcuate sections 6*a* and 6*b* run more or less along radial lines, which are angled at just below 90° in relation to one another. The section 6*b* is somewhat longer than the section 6*a*. The sections 6*c* and 6*d* run approximately concentrically with the center axis 4, the concentricity not quite being achieved on account of running toward the longer section 6*b*.

FIG. 1 also illustrates a rotary lid closure 10, as a section I—I from FIG. 4, which consists of metal or plastic and has an encircling annular wall 11 with funnel-shaped widening 12 and a rotary sliding wall 13. The rotary sliding wall 13 has a cut-out opening 15 which is of more or less the same shape as the bounded region 5 of the lid wall 2. Parts of the wall 13 in the region of the opening 15 are bent over in a loop-like manner in order to form a bead-like protrusion 16, as can best be seen from FIG. 5. A bead 17 is also provided, as a protrusion, in the wall 13 and engages in one indent 7*a*, 7*b* or the other in order to determine a defined open position and closed position for the can as a whole.

Figure 6:
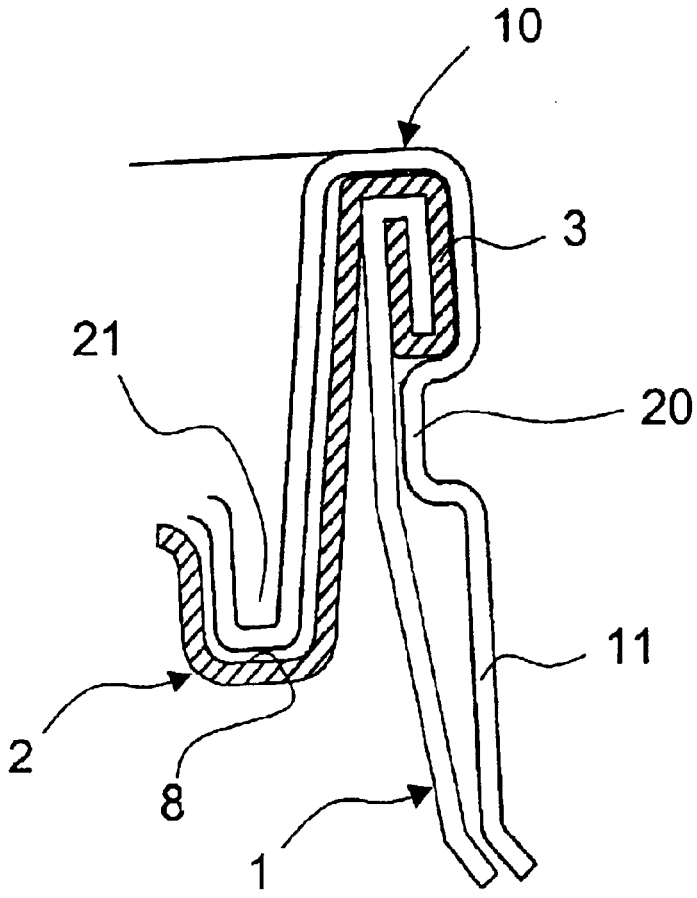
FIG. 6 shows a clip formation.

The rotary closure 10 is fitted onto the can 1 in the manner of a lid, and it engages behind the edge seam 3 by way of a number of clips 20, e.g. three resilient depressions (FIG. 6). In addition, a protruding annular corrugation 21 engages in the groove 8 in order for the rotary sliding wall 13 to be guided resiliently, and thus in a close-fitting manner, on the side wall 2 when the rotary closure is rotated. The rotary closure 10, in addition, is made particularly easy to grip by the annular wall 11 being designed with corrugation or knurling.

In order to achieve a pressure-tight closure, it is expedient to rubber-coat the front side 16*a* of the bead-like protrusion 16 and the underside of the wall 13, at 13*a*, or to provide the same with some other sealing coating.

It is further expedient to provide a bead-like sealing application around the bounded region 5, outside the predetermined breaking line 6, with the result that the contact pressure of the rotary closure 10 is greatest around the bounded region 5.

In the starting position of the can, or in the position in which the latter is supplied, the bead-like protrusion 16 is located within the bounded region 5, overlapping the edge region 6*a*. In this starting position, the protrusion 17 latches into the indent 7*a* and thus fixes this starting position. By using one's thumb to press on the bead-like protrusion 16, the notched weakening lines 6 can be made to break in the region 6*a*, as is illustrated at the top left of FIG. 5. The edge 11, 12 of the rotary closure 10 is then grasped and rotated in the counterclockwise direction, as seen in FIG. 4. The bead 16 then bends the bounded region 5 increasingly downward in the form of a lug 5*a*, as is outlined at the top right and bottom left of the illustration of FIG. 5. This forms the drinking or pouring opening 9, which takes up approximately the bounded region 5. This opening 9 can be freed by virtue of the rotary closure 10 being rotated back, as is illustrated at the bottom right of FIG. 5. In this position, the opening 9 and the cut-out opening 15 of the rotary closure 10 overlap, which allows maximum removal of the contents of the containers. Counterclockwise rotation can partially or wholly eliminate the overlapping position formed, with the result that the effective outlet opening is more or less pronounced or closed, the latter being the case when the bead 17 engages in the indent 7*b*.

Figure 5:
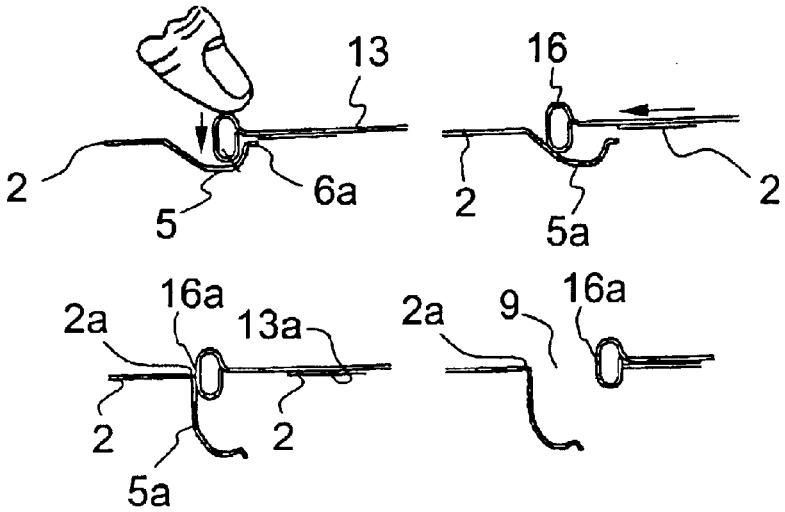
FIG. 5 shows schematic illustrations of the operation of opening the can.

In this closed position, the sealing coating 16*a* of the bead 16 comes into contact with the edge 2*a* of the opening 9, as is illustrated at the bottom left of FIG. 5, and the coating 13*a* seals against the wall 2.

Figure 7:
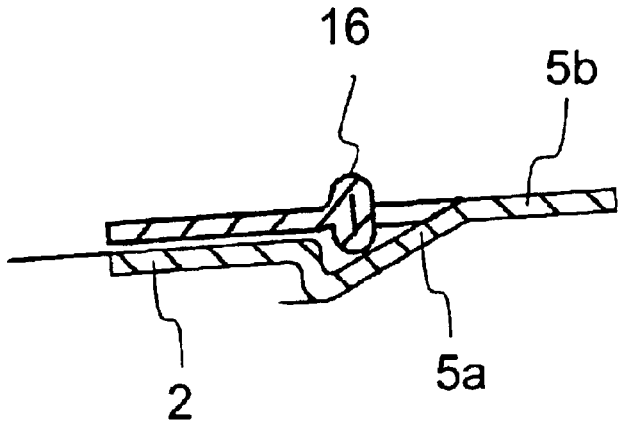
FIG. 7 shows an enlarged detail, in section.
Figure 8:
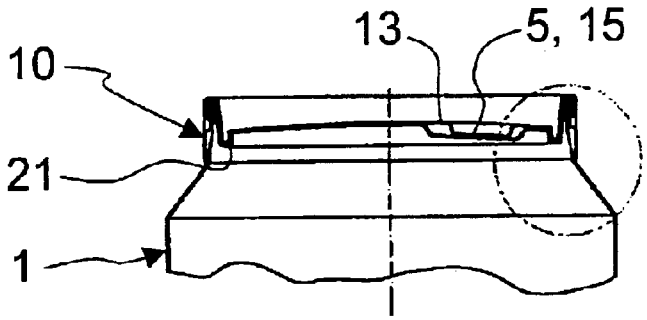
FIG. 8 shows a section through the top part of a second embodiment of the can with rotary closure.
Figure 9:
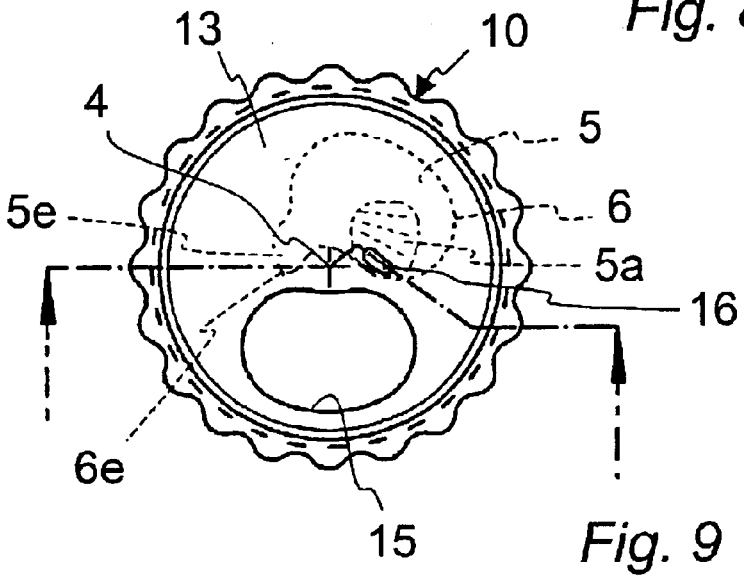
FIG. 9 shows a plan view of the can according to FIG. 8.

FIG. 7 shows the interaction of the bead 16 with the bounded region 5 without the aid of the thumb. The bounded region has three zones 5*a*, 5*c* and 5*d* with sloping surfaces as well as plateau zone 5*b*. If the rotary closure lid is rotated out of the starting position, the bead 16 slides along the sloping surface 5*a* in the direction of the plateau surface 5*b* as a result of which the pressure on the lid 2 increases and the weakening line breaks in the boundary region between 6*c* and 6*a*. This tear propagates via the region 6*a* into the region 6*d* and passes, via the region 6*b*, into the region 6*c*, in which the weakening line is interrupted in order that the separated-off part 5 remains attached to the lid 2 and does not fall into the interior of the container. The steeper the sloping surface of the zone 5*a*, the greater is the initial force which needs to be applied in order to cause the weakening line to break. The angle of the sloping surface is between 20 and 40°.

The rotary closure lid 10 is preferably dimensioned such that the base of an adjacent can fits into the top edge opening of the lid 10, with the result that it is possible for a number of cans to be stacked one above the other with mutual engagement.

FIGS. 8 to 13 show a second embodiment of the can with rotary closure. Parts which correspond to those of the first embodiment are provided with the same designations, and reference is made to the appropriate description of the first embodiment.

The notched weakening line 6 has a kidney-shaped outline with a convexity 6*e*, at which location the notched weakening line is interrupted. The bounded region 5 of the lid wall 2 is broken away in order to form the drinking opening 9, but, in order to be captive, remains attached to the lid wall in the region 5*e*. The bounded region 5 is broken out in a similar manner to the first embodiment, although the sloping surface 5*a* is somewhat narrower and longer than the sloping surface of the first embodiment. Accordingly, the protrusion 16 of the rotary lid closure 10 is shorter in the radial direction and only extends downward from the rotary sliding wall 13, i.e. it is designed as an indent or bead which assumes a certain spacing S1 (FIG. 13) from the cut-out opening 15, which is provided in the rotary sliding wall 13 and has a kidney-shaped or bean-shaped outline. The spacing between the indent or bead 16 and the axis of rotation 4 is designated S2. The depression of the kidney shape is at a certain spacing S4 from the axis of rotation 4 of the rotary lid closure 10 and at a spacing S3 from the edge of the lid wall 2. A sealing layer or a sealing bead is applied up to this spacing strip around the zone 5, which will be discussed in more detail in conjunction with FIGS. 14 to 16.

With the system of the invention, the closed half of the rotary sliding wall 13 overlaps the opening or the region 5, which could thus take up up to half of the surface area of the rotary sliding wall 13. Since it is desirable for the drinking opening 9 to have rounded edges, and since the broken-out section of the wall is to remain attached at the web 5*e*, the maximum size of the drinking opening 9 is correspondingly smaller. Since the drinking opening 9 is to be sealed, there is a need for a sealing surface around the opening. The spacings S1, S3 and S4 are thus required. In the embodiment described, the openings 9 and 15 have virtually achieved their maximum size for practical purposes. It would only still be possible to increase the size of the openings 9 and 15 to some extent by increasing the spacing S2 between the protrusion 16 and the axis of rotation 4, as a result of which the outlines of the openings 9 and 15 may be of somewhat more slot-like configuration. The radial extent of the opening 9 or 15 is r− (S3+S4), where r is the radius of the rotary sliding wall. This radial extent should be at least r/2, in order to achieve a sufficiently large drinking opening in the case of commercially available beverage cans of 65 mm in diameter. The protrusion 16 should extend approximately tangentially to the predetermined breaking line 6 and should pass over the region 5 approximately in its center. This means that the direction in which the protrusion 16 extends is at an angle of from approximately 30° to 60° to the radial line, in respect of the conditions from FIGS. 8 to 13. For the spacing S2, a range of from 0.3 to 0.6 r is preferred.

Figure 10:
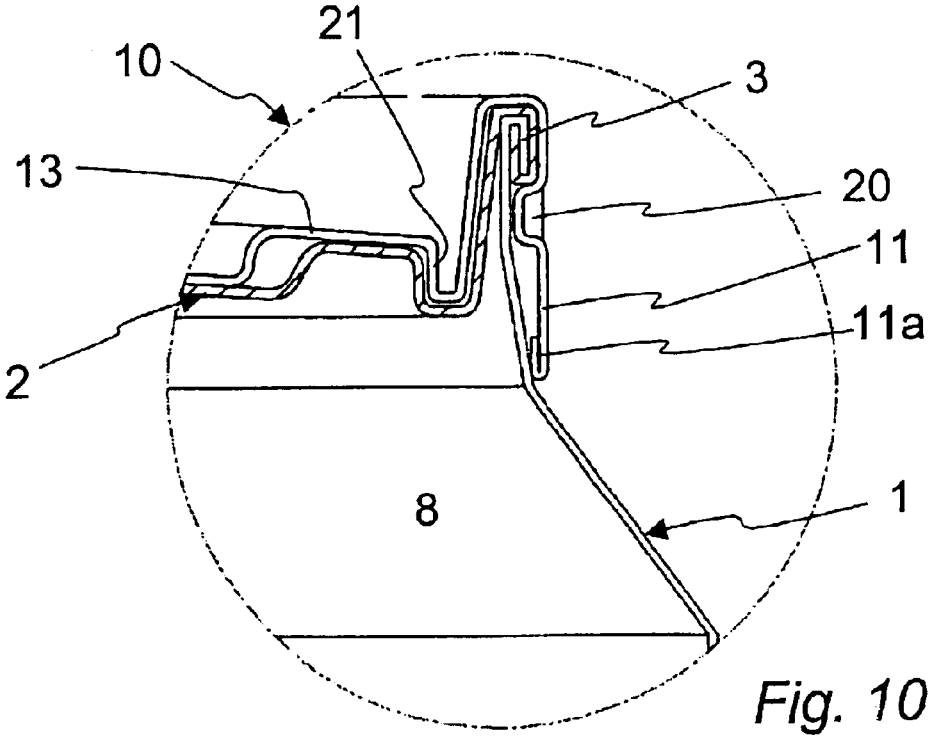
FIG. 10 shows an enlarged detail from FIG. 8, FIGS. 11 to 13 show the operations of opening and closing the can.

The rotary lid closure 10 is clipped onto the top end of the can in the same way as in the case of the first embodiment. However, the encircling annular wall 11 terminates with a flanged border 11*a*, as is illustrated in FIG. 10. As can be seen from FIG. 9, the annular wall 11 may be of corrugated form, in order for it to be possible for the rotary lid closure 10 to be rotated with greater force.

Figure 11:
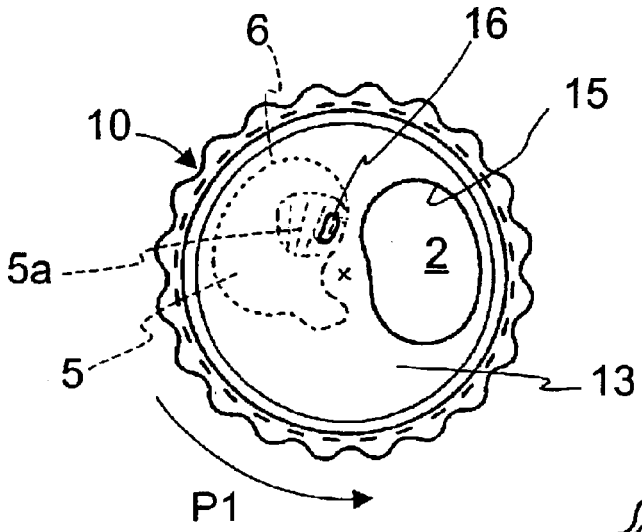
Figure 12:
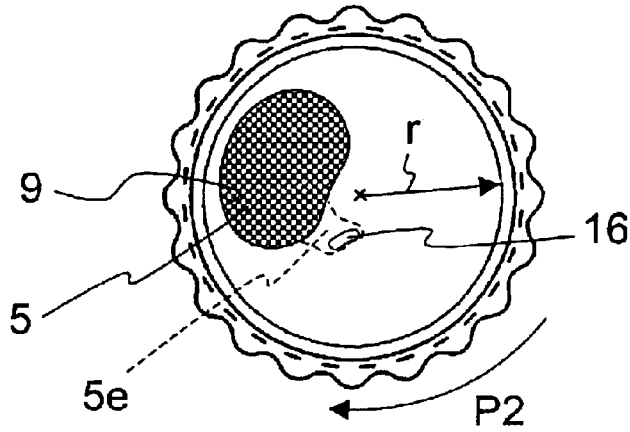
Figure 13:
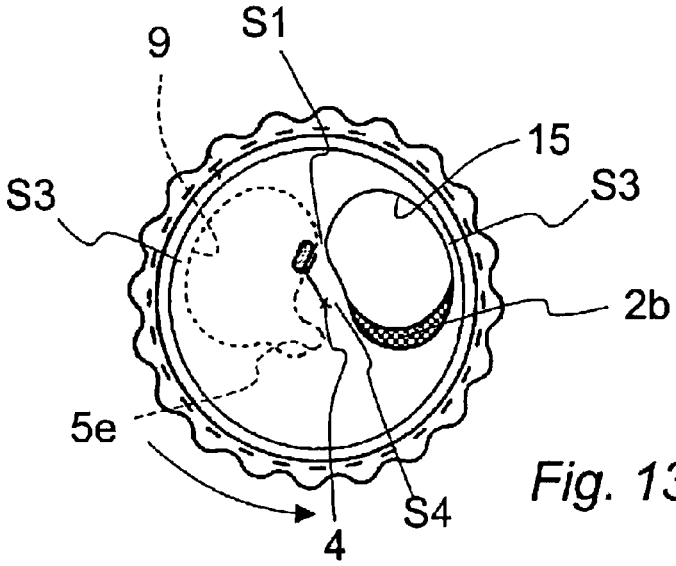

The handling of the rotary lid closure is outlined in FIGS. 11 to 13. FIG. 11 shows the position of the rotary lid closure 10 once it has been fitted in the position in which it is sold. If the customer wishes to open the can, he/she rotates the rotary lid closure 10 to the left, as is indicated by the arrow PI. The protrusion 16 moves over the sloping zone 5*a*, the increasing pressure ensuring that the notched line 6 breaks. During this rotation P1, the opening 15 passes into the bounded region 5 and, finally, overlaps the latter to the full extent, as is illustrated in FIG. 12. During this rotation in accordance with the arrow P1, the wall region 5 pivots into the interior of the can 1, but remains attached to the lid wall 2, as is illustrated at 5*e*. The drinking opening 9 is open to the maximum extent in the position of FIG. 12.

The rotary closure can be closed again by virtue of the part 10 being rotated to the right in accordance with the arrow P2. The position of the rotary lid closure according to FIG. 13 is then reached. In this case, the protrusion 16 comes into abutment against the edge of the open region 5. The angle position of the rotary closure 10 is thus somewhat different from the angle position in the starting position of FIG. 11. This means that a sickle-shaped region 2*b* is visible from the lid wall 2, which region was still concealed in the position of FIG. 11. This sickle-shaped region 2*b* may be marked in order to indicate to the expert that the can has been opened or that an attempt has been made to open it.

The tamper indicating feature) may also be realized in some other manner, for example by means of a seal which is adhesively bonded to the lid wall 2 and the rotary sliding wall 13 in the region of the opening 15. When the rotary lid closure 10 is rotated, this seal has to be destroyed, which indicates the unauthorized usage of the can.

The safety feature may also be provided in the region of the edge 11*a* of the annular wall 11, since it is also the case there that rotation of the closure 10 involves displacement relative to the can 1.

Figure 14:
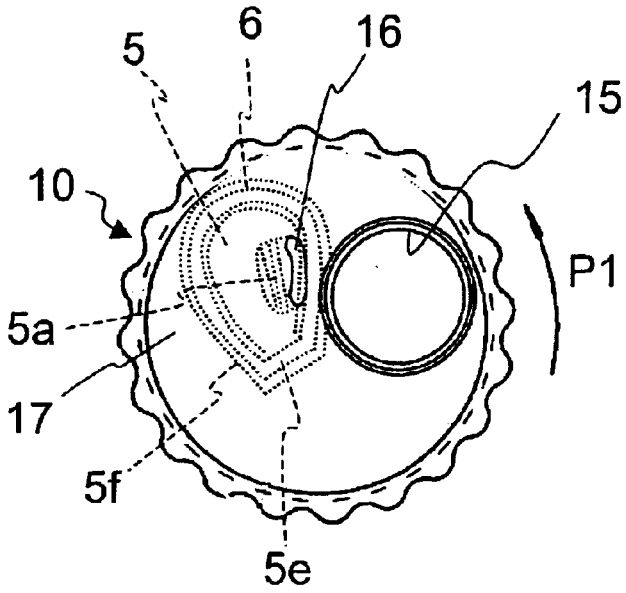
FIGS. 14 to 16 show the operations of opening and closing a variant of the can.
Figure 15:
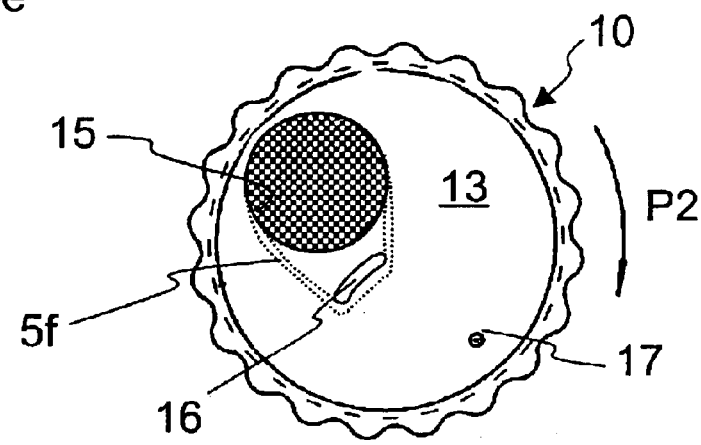
Figure 16:
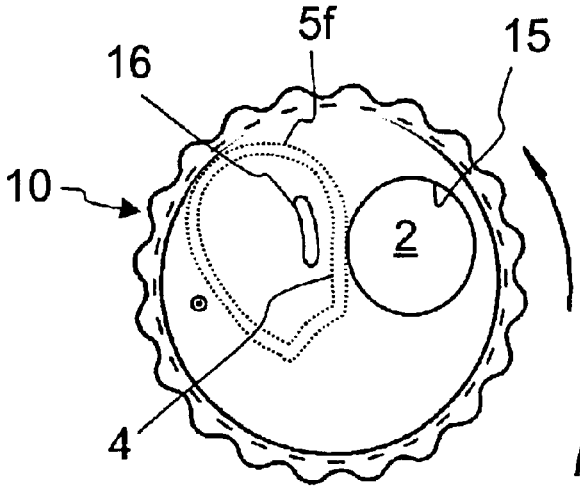

It may be expedient for containers to have a pouring opening with a round cross section, for example because it is desired to fit in a pouring tap or the like there. The variant according to FIGS. 14 to 16 shows such a circular access opening 15. The predetermined breaking lines 6 are approximately horseshoe-shaped and enclose a correspondingly configured region 5, around which a bead-like sealing region 5*f* extends. If the closure 10 is rotated to the left in accordance with arrow P1, the protrusion 16 moves over the sloping surface 5*a* and presses the wall region 5 downward, with the result that the predetermined breaking line 6 tears, with the exception of the region 5*e*, which remains attached. The part 10 contains a protrusion 17 which latches into a corresponding indent of the lid wall 2, as is similarly illustrated at 7*a* in FIG. 2. In this angle position of the rotary lid closure 10, the opening 15 overlaps the now open region 5 to the maximum extent, as is illustrated in FIG. 15. The rotary sliding wall 13 butts with pressing action against the sealing region 5*f*. It should be pointed out that the rotary sliding wall 13 is provided with resilient compliance, in particular in the region of the annular groove 21, so that the sealing abutment of the rotary sliding wall 13 against the sealing region 5*f* still functions even when the lid wall 2, as a result of the internal pressure loss when the can is opened, yields back to some extent, i.e. loses its original relatively large degree of curvature.

FIG. 15 shows the open position of the container, which can be transferred into the closed position of FIG. 16 by virtue of rotation to the right in accordance with arrow P2. From this position, the container can be opened repeatedly by virtue of the rotary lid closure 10 being rotated to the left in accordance with arrow P3.

The can 1 may be further developed as a music box, in which a microchip with micro power source and micro-loudspeaker is fitted on the lid or lid roof closure, the microchip taking effect when the can is opened, or when the rotary lid closure is rotated, and playing a melody, an advertisement or the like.

The novel rotary closure can be used not just for cans but also for other forms of containers or vessels which have a rotationally symmetrical wall with a lid wall which has to be torn open in order to form a pouring opening.

The novel rotary closure is very user-friendly. The cap-like design of the rotary closure allows convenient grasping without any risk of injury (i.e. without fingernails being broken or cuts being sustained on the ring pull, as in the case of prior-art containers). Moreover, the rotary closure provides a favorable lever action since the grip location 11 is located further outward relative to the actuating location 6/16. On account of the straightforward design, the additional costs of the rotary lid closure are only slightly higher than the hitherto conventional containers with ring pull tab, and these additional costs are offset by the advantages which can be achieved. The can can be opened and closed repeatedly and is leakproof and seals against the loss of carbonated beverage. With the can closed, there is no risk of insects, which could have fallen into the open containers, being swallowed (exclusion of warranty claims).

What is claimed is:

1. A container comprising:

a rotationally symmetrical wall region having a circumference which defines a container axis;

a lid wall, said lid wall having a top side and a circular circumference of a given radius length and being fixed to and along said circumference of said rotationally symmetrical wall region;

a bounded region of said lid wall, said bounded region extending between said container axis and said circular circumference of said lid wall and being enclosed by a predetermined breaking line which, once fractured, releases a single drinking and pouring opening;

a depression having a sloping surface formed by wall portions of said lid wall within said predetermined breaking line;

a rotary lid closure having a wall which spans said lid wall, an opening cut out therein and a protrusion for sliding on said sloping surface and to break open said drinking and pouring opening;

means for supporting said rotary lid closure when the latter is rotated about said axis for opening said drinking and pouring opening and for moving said rotary lid closure between a fully open position and a fully closed position;

wherein said depression with sloping surface of said lid wall is arranged at a location of said bounded region which is overlapped by said cut-out opening when said rotary lid closure has been rotated in said fully open position of said drinking and pouring opening;

wherein said protrusion is formed from wall portions of said rotary lid closure; and wherein said wall of said rotary lid closure engages said top side of said lid wall elastically and with pressure thereon so as to seal said drinking and pouring opening once the latter has been opened and said rotary lid closure has been rotated in said fully closed position.

2. The container as claimed in claim 1, wherein there is a spacing between said protrusion and said container axis which is in the range of from 0.3 to 0.6 radius length of said lid wall, and wherein said drinking and pouring opening has a radial dimension of at least half said radius length.

3. The container as claimed in claim 1 or 2, wherein said rotationally symmetrical wall region is connected to said lid wall via an edge seam and said rotary lid closure is designed in the form of a cap for engaging round said edge seam, so as to form said supporting means at least partially, and wherein said rotary lid closure has a grip region which has a lever length which relative to the axis of rotation which is greater than the spacing between said protrusion and said container axis.

4. The container as claimed in claim 3, wherein a number of clips are provided on said cap for engaging round said edge seam.

5. The container as claimed in claim 3, wherein said grip region of said rotary lid closure is corrugated.

6. The container as claimed in claim 1, wherein said bounded region of said lid wall is surrounded by a sealing coating.

7. The container as claimed in claim 6, wherein interacting latching means are provided on said lid wall and said rotary lid closure for arresting said rotary lid closure in said fully open position or in said fully closed position.

8. The container as claimed in claim 1, wherein said bounded region has a kidney-shaped outline.

9. The container as claimed in claim 1, wherein said predetermined breaking line is only nearly closed, so that some wall material of said line around said bounded region remains unbroken and attached to said lid wall in captive fashion in the form of a lug, when the drinking and pouring opening is initially opened.

10. The container as claimed in claim 1, wherein said rotary lid closure has an annular corrugation arranged to press said rotary sliding wall resiliently onto said lid wall.

11. A container comprising side walls, a bottom wall, a top wall and an opener-shutter;

said top wall being joined to said side walls along a cylindrical edge seam and including a substantially flat region and a depressed region;

said depressed region having a sloping surface formed by wall portions of said top wall;

a weakened region on said top wall bounded by a notched line which surrounds said depressed region;

said opener-shutter including a substantially flat wall portion having an opening in it and a downward extending projection on its lower side, and an annular wall portion which is joined to said flat wall portion;

said annular wall portion of the opener-shutter being adapted to cooperate with said side walls and said cylindrical edge seam of the container so as to support and guide said opener-shutter when the same is rotated between a fully closed and a fully opened position of the container;

said downward extending projection on the opener-shutter comprises wall material of said substantially flat wall portion and, in said fully closed position of the container, is nested within said depressed region, and when the opener-shutter is rotated, rides up the slope of the depressed region and breaks said notched line of said weakened region so as to create a dispensing opening for the container;

said substantially flat wall portion of the opener-shutter engages said substantially flat region of said top wall elastically and with pressure thereon so as to seal said dispensing opening once the latter has been opened and said opener-shutter has been rotated in said fully closed position.

12. The container set forth in claim 11, wherein said cylindrical edge seam comprises an outer lower surface and wherein said annular wall portion of said opener-shutter is formed with clip means adapted to engage said outer lower surface of said cylindrical edge seam.

13. The container set forth in claim 11, wherein said annular wall portion of said opener-shutter includes an annular portion corrugated in a radial plane and connected to said substantially flat wall portion in such a manner as to create some pressure between said substantially flat wall portion of said opener-shutter and said substantially flat region of said top wall.

14. The container set forth in claim 12, wherein said opener-shutter is in the shape of a cap adapted to cover said top wall and an upper zone of said side walls of the container which upper zone is adjacent to the top wall.

15. The container set forth in claim 14, wherein said cap has an outer wall which is corrugated along the periphery thereof.

16. The container set forth in claim 11, wherein said shutter opening and said dispensing opening have the same size and shape with the exception of a captive region on the container top wall which projects from the outlines of the shutter opening when the same registers to the dispensing opening, said captive region being a top wall region where the wall portions bounded by said notched line remain attached to the top wall also when the container has been opened.

17. The container set forth in claim 16, wherein said downward extending projection of said opener-shutter, in said fully open position of the container when the shutter opening and the dispensing opening register, is arranged in said captive region.

18. The container set forth in claim 11, wherein said flat wall portion of the opener-shutter is of circular cross-section having a rotary axis and a radius r, said downwardly extending projection of said opener-shutter being of a lengthy configuration at an angle of from approximately 30° to 60° to a radial line between the projection and the rotary axis of the opener-shutter, and a spacing in a range from 0.3 to 0.6 r to said rotary axis.

19. The container set forth in claim 11, wherein means for limiting the rotation of said opener-shutter relative to said top wall is provided, said rotation limiting means defining said fully closed and said fully open positions.

20. The opener-shutter of claim 11, wherein said opener-shutter is in the shape of a cap adapted to cover said top wall and an upper zone of said side walls of the container which upper zone is adjacent to the top wall.

21. The opener-shutter of claim 20, wherein said cap has an outer wall which is corrugated.

* * * * *